US007806737B2

(12) United States Patent
Mark et al.

(10) Patent No.: US 7,806,737 B2
(45) Date of Patent: Oct. 5, 2010

(54) STAMPED BEAM CONNECTOR

(75) Inventors: Gregory T. Mark, Cambridge, MA (US); Andrew M. Wallace, Cambridge, MA (US); Hannah Han, Fremont, CA (US); Walter William Wurster, Reno, NV (US); Michael Allen Gustafson, Reno, NV (US); Russell G. Larsen, San Jose, CA (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 12/025,734

(22) Filed: Feb. 4, 2008

(65) Prior Publication Data

US 2009/0197482 A1 Aug. 6, 2009

(51) Int. Cl.
*H01R 13/187* (2006.01)

(52) U.S. Cl. ..... 439/843

(58) Field of Classification Search ..... 439/843, 439/851, 181, 520
See application file for complete search history.

(56) References Cited

U.S. PATENT DOCUMENTS

| | | | | |
|---|---|---|---|---|
| 2,394,020 | A | | 2/1946 | Soreny |
| 3,530,422 | A | | 9/1970 | Goodman |
| 3,665,370 | A | | 5/1972 | Hartmann |
| 3,927,926 | A | | 12/1975 | Powell |
| 4,227,767 | A | | 10/1980 | Mouissie |
| 4,462,657 | A | | 7/1984 | Snowdon et al. |
| 4,810,213 | A | | 3/1989 | Chabot |
| 4,927,369 | A | | 5/1990 | Grabbe |
| 5,030,109 | A | | 7/1991 | Dery |
| 5,061,191 | A | | 10/1991 | Casciotti et al. |
| 5,088,942 | A | | 2/1992 | Welsh |
| 5,092,781 | A | | 3/1992 | Casciotti et al. |
| 5,094,636 | A | * | 3/1992 | Zinn et al. ..... 439/839 |
| 5,154,626 | A | | 10/1992 | Watson |
| 5,232,372 | A | | 8/1993 | Bradley |
| 5,273,438 | A | | 12/1993 | Bradley et al. |
| 5,297,968 | A | | 3/1994 | Johnson et al. |
| 5,634,801 | A | | 6/1997 | Johnson |
| 5,667,413 | A | * | 9/1997 | Trafton ..... 439/843 |
| 5,730,628 | A | | 3/1998 | Hawkins |
| 5,913,687 | A | | 6/1999 | Rathburn |
| 6,062,919 | A | | 5/2000 | Trafton |
| 6,102,746 | A | | 8/2000 | Nania et al. |

(Continued)

FOREIGN PATENT DOCUMENTS

| | | |
|---|---|---|
| FR | 465535 | 4/1914 |

(Continued)

OTHER PUBLICATIONS

PCT Search Report dated Mar. 10, 2009.

(Continued)

*Primary Examiner*—Khiem Nguyen
(74) *Attorney, Agent, or Firm*—Barnes & Thornburg LLP

(57) ABSTRACT

An electrical connector includes a first and second array of flexible beams that are overlapped within a hood and that define a substantially cylindrically cavity for receiving a mating connector. Contact areas of each of the flexible beams may be shaped to define multiple contact points, thus increasing the overall area available for current to pass.

39 Claims, 6 Drawing Sheets

U.S. PATENT DOCUMENTS

| | | | | |
|---|---|---|---|---|
| 6,206,713 | B1 | 3/2001 | Baertsoen | |
| 6,250,974 | B1 * | 6/2001 | Kerek | 439/843 |
| 6,264,508 | B1 * | 7/2001 | Lehmann | 439/843 |
| 6,313,523 | B1 | 11/2001 | Morris | |
| 6,439,894 | B1 | 8/2002 | Li | |
| 6,447,317 | B1 | 9/2002 | Billman | |
| 6,471,555 | B2 | 10/2002 | Creze | |
| 6,659,778 | B2 | 12/2003 | Li | |
| 6,666,690 | B2 | 12/2003 | Ishizuka | |
| 6,695,633 | B2 | 2/2004 | Longueville et al. | |
| 6,805,594 | B2 | 10/2004 | LaCoy | |
| 6,942,496 | B2 | 9/2005 | Sweetland et al. | |
| 6,945,790 | B2 | 9/2005 | Sweetland | |
| 6,951,465 | B2 | 10/2005 | Sweetland | |
| 6,958,616 | B1 | 10/2005 | Mahoney | |
| 6,971,927 | B2 * | 12/2005 | Anbo et al. | 439/852 |
| 7,223,111 | B2 | 3/2006 | Sweetland | |
| 7,021,957 | B2 | 4/2006 | Sweetland et al. | |
| 7,056,139 | B2 | 6/2006 | Sweetland | |
| 7,070,419 | B2 | 7/2006 | Brown et al. | |
| 7,077,573 | B2 | 7/2006 | Suh et al. | |
| 7,077,662 | B2 | 7/2006 | Sweetland et al. | |
| 7,083,427 | B2 | 8/2006 | Sweetland et al. | |
| 7,094,064 | B2 | 8/2006 | Sweetland et al. | |
| 7,097,495 | B2 | 8/2006 | Sweetland | |
| 7,101,194 | B2 | 9/2006 | Sweetland et al. | |
| 7,125,281 | B2 | 10/2006 | Sweetland | |
| 7,140,916 | B2 | 11/2006 | Sweetland | |
| 7,458,827 | B2 | 1/2007 | Sweetland | |
| 7,214,106 | B2 | 5/2007 | Sweetland | |
| 7,311,566 | B2 | 12/2007 | Dent | |
| 7,547,215 | B1 | 6/2009 | Mark | |
| 2003/0003784 | A1 | 1/2003 | Neidich | |
| 2003/0174949 | A1 | 9/2003 | Bhardwaj et al. | |
| 2004/0002234 | A1 | 1/2004 | Masao | |
| 2004/0214454 | A1 | 10/2004 | Sweetland et al. | |
| 2006/0134943 | A1 | 6/2006 | Sweetland et al. | |
| 2006/0141814 | A1 | 6/2006 | Li | |
| 2008/0293307 | A1 | 11/2008 | Wallace et al. | |
| 2008/0293308 | A1 | 11/2008 | Mark | |
| 2009/0197476 | A1 | 8/2009 | Wallace | |
| 2009/0197481 | A1 | 8/2009 | Mark et al. | |
| 2009/0197482 | A1 | 8/2009 | Mark et al. | |

FOREIGN PATENT DOCUMENTS

| | | | |
|---|---|---|---|
| JP | 10012777 | A | 1/1998 |
| WO | 2004/036697 | A1 | 4/2004 |
| WO | 2005/001998 | A2 | 1/2005 |
| WO | 2008/153764 | A2 | 12/2008 |

OTHER PUBLICATIONS

International Search Report and Written Opinion from International Patent Application No. PCT/US2009/032036 (2009).
International Search Report and Written Opinion from International Patent Application No. PCT/US2009/031970 (2009).
International Search Report and Written Opinion from International Patent Application No. PCT/US2009/032033 (2009).
International Search Report & Written Opinion from Int'l Application No. PCT/US09/32017 (2009).

* cited by examiner

STAMPED BEAM CONNECTOR

BACKGROUND

1. Field

The invention relates to electrical connectors.

2. Discussion of Related Art

Electrical connectors are used to provide a separable path for electric current to flow between components of an electrical system. In many applications, numerous connections between components can, in turn, require numerous data and/or power connections within a given electrical connector. Lately, there has been increase in the number of connections required for typical electronic components, which in turn has created a demand for greater numbers of electrical connections. There has also been a general reduction in the size of electronic components, which has created demand for smaller electrical connectors. Demands for low cost connectors have remained, despite each of the above increases in demands on performance. The applicant has appreciated that there is a need for a low cost, electrical connector that has a relatively small size and that can convey electrical current with minimal losses.

SUMMARY

According to one aspect of the invention, an electrical connector for mating with a mating connector is disclosed. The electrical connector comprises a first array of flexible beams that extend from a base. The first array of flexible beams is arranged about a cavity that is configured to receive the mating connector. Distal portions of the flexible beams of the first array extend inwardly toward the cavity to define a first set of contact points that provide an electrical connection with the mating connector, when received in the cavity. A second array of flexible beams extend from the base and are nested inside of the first array of flexible beams. Distal portions of the second array of flexible beams extending inwardly toward the cavity to define a second set of contact points that provide an electrical connection with the mating connector, when received in the cavity.

According to another aspect of the invention, an electrical connector is disclosed for connecting to a mating connector. The electrical connector comprises a first array of flexible beams that extend from a base. The first array of flexible beams is arranged about a substantially cylindrical cavity that is configured to receive the mating connector. Distal portions of each flexible beam of the first array extend inwardly toward the cavity and have a contact area with a surface that defines two or more contact points to provide an electrical connection with the mating connector, when received in the cavity. The two or more contact points are spaced from one another along a radius that revolves about the substantially cylindrical cavity.

According to another aspect of the invention, a method of forming an electrical connector is disclosed. The method comprises providing a sheet of conductive material. Portions of the sheet are lanced to separate a first array of flexible beams from a second array of flexible beams. The first and second array of flexible beams remain connected to one another through a base portion of the sheet. Distal portions of the first array of flexible beams are bent to define a first set of contact areas. Distal portions of the second array of flexible beams are bent to define a second set of contact areas. The base and first and second arrays of flexible beams are bent to define a substantially cylindrical cavity configured to receive a mating connector.

According to yet another embodiment, a method of forming an electrical connector is disclosed. The method comprises providing a first and second sheet portions of conductive material. The first sheet portion is blanked to define a first base portion and a first array of flexible beams extending therefrom. The second sheet portion is blanked to define a second base portion and a second array of flexible beams extending therefrom. Distal portions of the first array of flexible beams are bent to define a first set of contact areas and distal portions of the second array of flexible beams are bent to define a second set of contact areas. The first and second arrays of flexible beams are bent to define a substantially cylindrical cavity configured to receive a mating connector. The second array of flexible beams is nested in the first array of flexible beams.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labeled in every drawing.

Various embodiments of the invention will now be described, by way of example, with reference to the accompanying drawings, in which.

DETAILED DESCRIPTION

An aspect of the invention described herein relates to including a first and a second array of flexible beams in a connector. The flexible beams provide an electrical connection to a mating connector, when received in a cavity that lies between at least some of the beams. A distal portion of each flexible beam includes a contact point that makes electrical contact with the mating connector. The first and second arrays of flexible beams may be overlapped with one another. In this respect, an overall size of the electrical connector may be reduced, while providing an increased number of contacts and/or contact area for engagement with a mating connector.

According to another aspect of the invention, the flexible beams may have contact areas shaped to define multiple contact points that contact a mating connector. In this respect, the total number of contact points may be increased, and correspondingly, the current carrying capacity of the connector may also be increased.

According to another aspect of the invention, the connector may be manufactured through a stamping process, such that the connector may be produced cost effectively.

According to another aspect, the first and second arrays of flexible beams may be lanced from a common sheet of material. This may be accomplished without removing any material that lies between flexible beams of the first and second arrays, which may reduce the amount of material used to manufacture the connector, and thus reduce production costs.

According to yet another aspect, contact points of the first and second arrays of flexible beams may be separated from one another along the direction in which the mating connector is received, which may allow additional contacts to be included within the connector.

Figure 1:
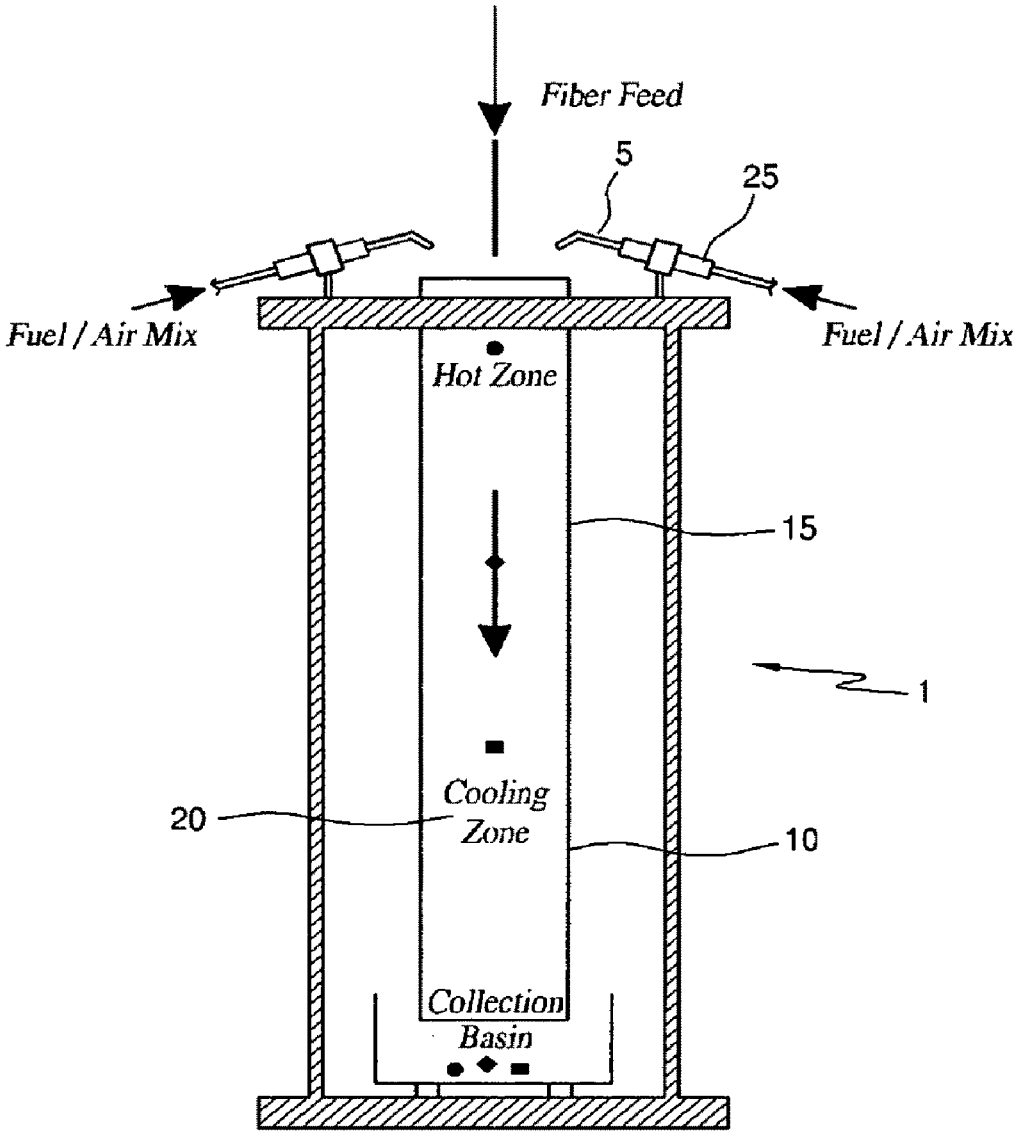
FIG. 1 shows a schematic, cut-away view of an electrical connector, according to one embodiment.

Turn now to the figures, and initially FIG. 1, which shows a cut-away view of an electrical connector, according to one embodiment. The connector includes a hood 10, a first array 12, and a second array 14 of flexible beams 16 that each include one or more contact points 18. Together with the hood, the flexible beams and contact points define a substantially cylindrical cavity 20 in which a mating connector 22 may be received. Each array of flexible beams is connected to a base 24 at one end, and at the other end has a contact area 26 with one or more contact points 18 that extend inwardly of the cylindrical cavity such that they may make an electrical connection with a mating connector, when received. Another illustrative embodiment, shown in FIG. 2, includes a first and second array of flexible beams that are formed from a common portion of material, and that have a common base 24.

Figure 2:
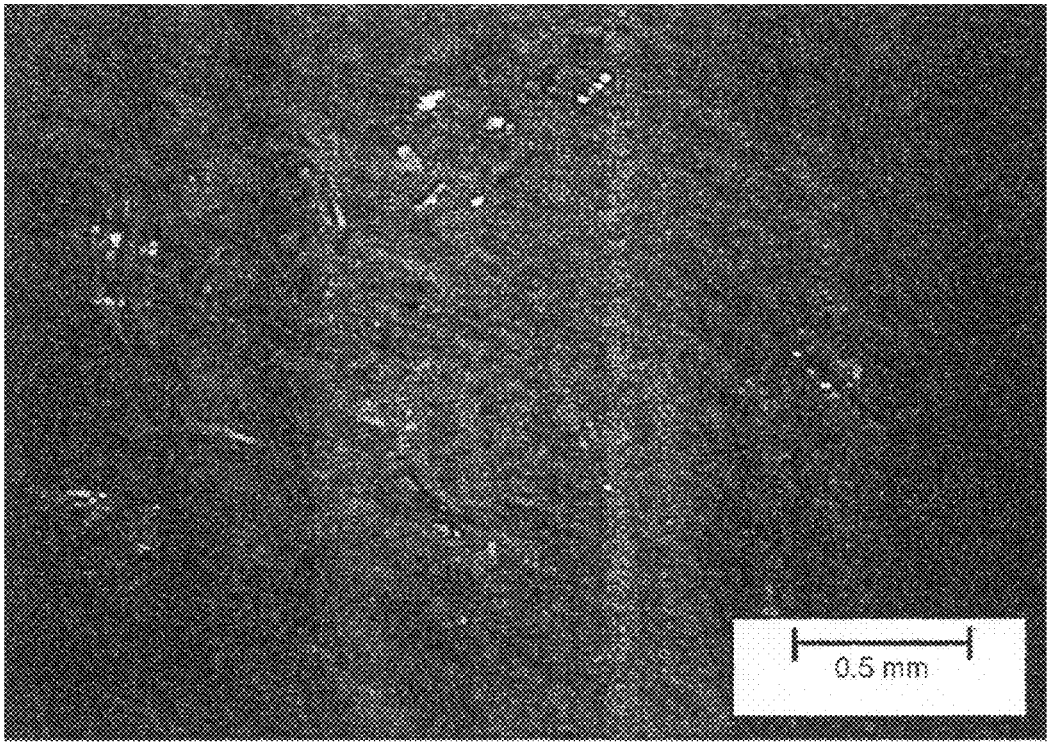
FIG. 2 shows a schematic, cut-away view of an electrical connector having a first and a second array of flexible beams formed from a common sheet of material, according to one embodiment.

Embodiments of invention include various features to increase the amount of contact area with a mating connector without also necessarily increasing the size of the overall envelope occupied by the connector. One such feature includes the radius about which contacts of the first and second arrays lie. The flexible beams shown in FIGS. 1 and 2 are connected to a base that lies at a radius that is larger than that on which the contact areas lie. In this respect, any gap 27 between each of the flexible beams at the contact areas may be smaller than the gap between the flexible beams near the base 24. This reduction in gap size at the contact areas may allow for additional beams to be included in a connector and/or for larger contact areas at each connector, either of which may increase the total area of contact with the mating connector and reduce the overall electrical resistance associated with the connector. In some embodiments, the flexible beams may contact one another, thus eliminating any gaps therebetween, at least when a mating connector is not present in the cavity. It is, however, to be appreciated that not all embodiments include flexible beams configured to reduce gap size between contacts, as aspects of the invention are not limited in this respect. By way of example, connectors may be configured such that the base and array(s) of flexible beams do not extend about a curved surface, such as in embodiments that include a slot-like cavity for receiving a mating connector.

Arrays of flexible beams may be overlapped or nested with one another to increase the area available to make contact with a mating connector, without also necessarily increasing the overall size of the connector. Examples of such overlapped connectors are shown in the embodiments of FIGS. 1 and 2. Configuring the beams in a nested manner, as shown, may help reduce the overall length of the connector, taken along the "insertion direction"—the direction in which the mating connector is inserted to the cavity of the connector. Overlapped configurations may allow the flexible beams to have lengths appropriate for the desired contact forces, displacement ranges, and/or other features that may be desirable for a particular connector, without also increasing the overall connector envelope. Although FIGS. 1 and 2 show a pair of nested flexible arrays, it is to be appreciated that a connector having a single array, or more arrays than two, are also possible. By way of example, some embodiments may have 3 arrays, 4 arrays, 5 arrays or even more than 5 nested arrays of flexible beams.

As used herein, the terms 'overlapped' or 'nested', refer to portions of a second array of flexible beams being positioned, at least partially, between the cavity and a first array of flexible beams. Individual beams do not have to be precisely aligned over gaps or beams of another array to be considered 'overlapped' or 'nested'. Neither do flexible beams of different arrays within a connector have extend the same length in the direction of insertion within a connector to be considered 'overlapped' or 'nested'.

Overlapping arrays of flexible beams, as shown in the embodiments of FIGS. 1 and 2, may, additionally or alternately, allow the insertion length of a connector to be reduced. As used herein, the term "insertion length" refers to the length that a mating connector must travel, along the insertion direction, until the full electrical pathway between the electrical connector and mating connector is realized, after an initial electrical contact is made. In the embodiments of FIGS. 1 and 2, the insertion length is the distance between the contact points 18 of the first 12 and second 14 arrays, taken along the direction of insertion.

The flexible beams may be made of a resilient material, such as beryllium copper or other conductive material, so that flexing of the beams themselves may provide contact forces between the contact points of the connector and the mating connector. In this respect, additional mechanical elements for providing a biasing force may be omitted from the connector altogether, which may also help maintain a high ratio contact area to connector envelope size. It is to be appreciated, however, that additional mechanical elements may be included to provide contact forces, as aspects of the invention are not limited in this respect.

Embodiments of the connector may incorporate various features to promote a good electrical connection with the mating connector. As is to be appreciated, a degree of wiping between contact points of the connector and the surface of a mating connector may be desirable during the connection process. This wiping action may remove undesirable oxidation, impurities, and/or debris that might exist on the contact points and/or the mating connector. However, too much wiping may remove coatings from the mating element and/or contact points or otherwise damage portions of a connector, and thus it may be desirable to limit the amount of wiping that occurs in any one area.

Figure 3:
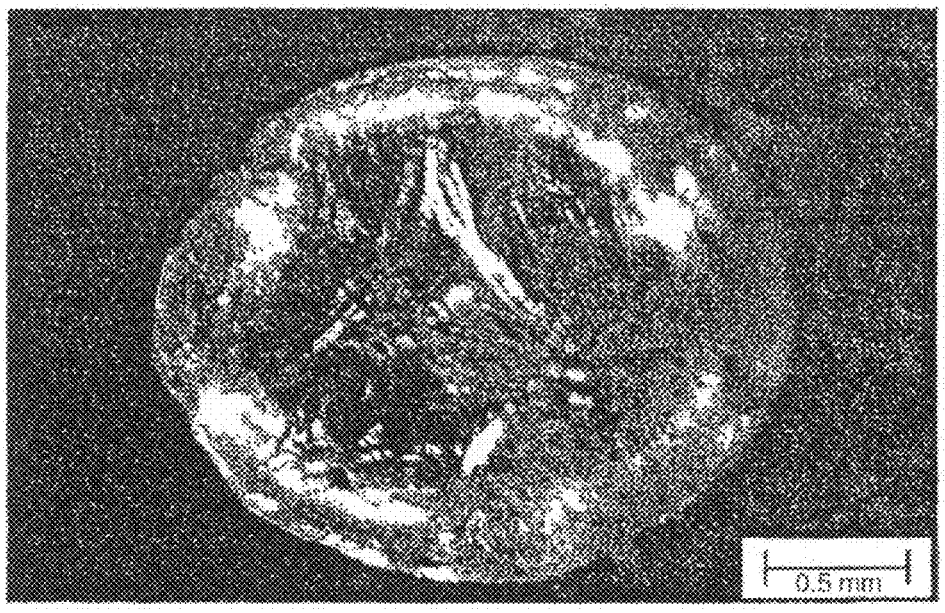
FIG. 3 shows a schematic representation of a first set of contact points that are staggered relative to a second set of contact points, according to one embodiment.

According to some embodiments, the contact points associated with the first array and second array may be rotated about the cavity, relative to contacts of the second set (that is, rotated about an axis that lies parallel to the insertion direction, as represented schematically in FIG. 3). In this respect, each contact point may wipe a different area of a mating connector, when inserted, to help prevent excess wiping from occurring at any one given spot. According to some embodiments, flexible beams of the second array may be aligned over the gaps of the first array with respect to one another, as shown in FIG. 3 and as occurs inherently in the embodiment shown in FIG. 2. It is to be appreciated that not all embodiments may have contact points rotated about the cavity relative to one another, as aspects of the invention are not limited in this respect. Moreover, other approaches may be used, additionally or alternately, to control the amount of wiping between contact points and a mating connector.

Figure 4:
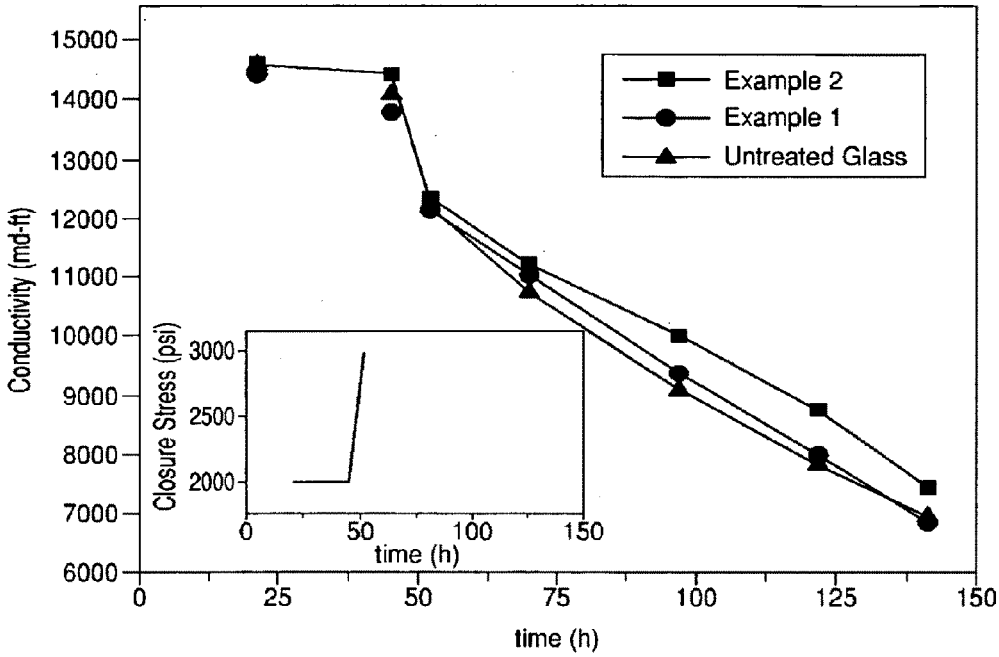
FIG. 4 shows an end view of a connector, including contact areas of a flexible beams, and a close-up cross section view of one contact area having multiple contact points, according to one embodiment.

Surfaces 30 of the contact areas that face toward the cavity may be shaped to provide multiple contact points 18 separated from one another in a direction orthogonal to the insertion direction. According to some embodiments, the surface 30 may be shaped to have a concave curvature 32 as shown in FIG. 4, to help accomplish this effect. The curvature, as shown, is greater than that of the mating connector 22 such that the contact area should touch the mating connector at two contact points, positioned at lateral portions of the surface that faces the cavity. Contact points of each flexible beam formed in this manner will make contact with a mating connector at substantially the same time during the insertion process. Providing two contact points for each flexible beam may ultimately provide a greater area for electrical connection with a mating connector that has a rounded surface, particularly since otherwise matching the curvature of a contact point to that of a mating connector may be difficult to accomplish. The curved surface of the contact area may be formed through various approaches, including a coining operation, or through various other techniques, as aspects of the invention are not limited in this respect. The surface may also include shapes other than a concave curvature, as aspects of the present invention are not limited in this respect.

Figure 5:
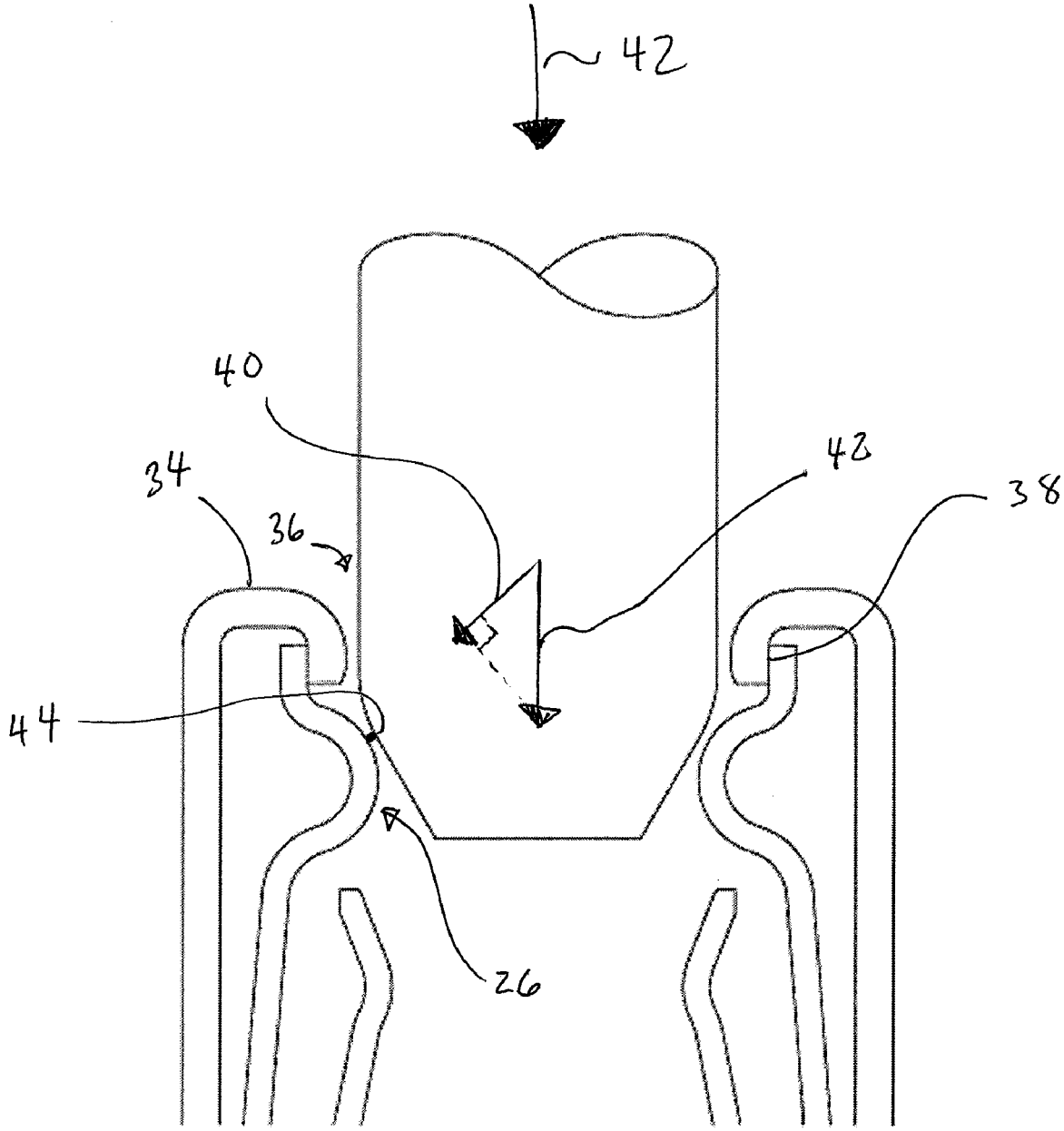
FIG. 5 shows a schematic representation of interaction between contact points of one embodiment of a connector, and a mating connector.

Embodiments of the invention may include features to promote proper insertion of a mating connector. One such feature includes the hood 34 at the opening of the connector, as shown in FIGS. 1, 2, and 5. The hood has an aperture 36 that defines the maximum diameter of mating connector that may be inserted into the cavity. In this respect, the aperture may prevent oversized mating connectors from inadvertently being inserted into cavity, which might otherwise damage the connector.

The hood, or other features of the connector, may engage the flexible beams to prevent stubbing. Stubbing occurs when a flexible beam moves across the cavity, instead of away from the cavity, upon insertion of a mating connector, and can result in an improper connection or damage. The hood embodiments of FIGS. 1, 2 and 5, includes a lip 38 that engages the flexible beams of the first array to prevent inward movement beyond a particular point, and in this respect, may prevent stubbing. It is to be appreciated that other features may be incorporated into the connector to prevent stubbing. By way of example, the flexible beams of the second array, as shown in FIGS. 1 and 2, include distal ends that are angled away from the cavity. The angled end help promote an outward movement of the beams upon engagement with a mating connector, which may help prevent stubbing. As also shown, the distal ends of the flexible beams in the second array lie along a radius that is about equal to or larger than that of pins that may be received through the hood of the connector. This arrangement may prevent a mating connector from directly contacting the extreme distal end of the flexible beam, and thus may prevent stubbing.

The shape of the contact area may help reduce the maximum insertion force that is necessary to insert a mating connector. FIG. 5 shows, schematically, forces associated with inserting a radiused mating connector into the connector, according to one embodiment. As shown, the arrangement of the contact and mating connector causes an initial portion 40 of the insertion force 42 applied along the direction of insertion, to be directed outwardly, in a radial direction that is substantially perpendicular to the insertion direction of the connector. This outward radial force 40 may help push the flexible beams of the first array (or any other arrays) outwardly. As the pin moves further into the cavity of the connector, the point of engagement 44 between the mating connector and the contact point may move about the radiused surface of the mating connector, such that less of the insertion force is directed radially outward and a greater proportion is directed along the direction of insertion.

Features of the connector may be configured to control the minimum contact force that is applied by some or all of the contact points to the mating connector. In one example, the flexible beams may be preloaded against the hood, as shown in FIG. 5, which helps ensure that a contact force at least equal to the preload is applied to a mating connector if a corresponding flexible beam is moved at all away from the hood. According to some embodiments, the flexible beams, at least of the first array, may be preloaded with a force of about 5 grams per contact point on the beam. That is, for beams with a single contact point, the preload may be about 5 grams, and for beams with a curved face having a contact point on either lateral side, as shown in FIG. 4, the preload may be about 10 grams. It is, however, to be appreciated that preloads of greater or smaller magnitudes are also possible. Preloads may typically be expected to range between about 3 grams and about 75 grams per contact point for embodiments that are configured to mate with a 0.094 diameter pin (size 12). Preloads for mating connectors of other sizes may lie within this range, or may even be greater, as aspects of the invention are not limited in this respect.

The maximum insertion force required to insert a mating connector may also be controlled through various schemes, such as by having contact points arranged to make contact with the mating connector at different times during insertion. This is accomplished in the embodiments of FIGS. 1 and 2 by separating contacts associated with the first and second arrays of flexible beams along the direction of insertion. As is to be appreciated, initial contact between the mating connector and a contact point in the connector may be associated with a greater force, at least until the contact point is moved outwardly, through its range of motion, away from the cylindrical cavity of the connector. In the embodiments of FIGS. 1 and 2, the contact points of the first array of flexible beams are moved at least partially through their range of motion prior to contact being made between the mating connector and contact points of the second array of flexible beams. Since the contact points associated with the second array are moved through their range of motion at a later time, the greater forces associated with initially moving these contact points outwardly is not present at the same time, during insertion, as the greater forces associated with moving the contact points of the first array. Consequently, the overall maximum insertion force may be reduced.

According to one illustrative embodiment, flexible beams of the first array (or any other array) are configured such that the contact points are staggered, relative to one another, in the direction of insertion. In such embodiments, contact points of the first array move through their range of motion at different times to further reduce the maximum insertion force for inserting a mating connector.

As discussed herein, arrays of flexible beams being overlapped in the connector may help reduce the insertion length of a connector. This aspect of the invention may prove particularly helpful in embodiments like that described above, where contact points of a common array are staggered relative to one another in the direction of insertion. It is to be appreciated, however, that embodiments may have flexible beams with corresponding contact points arranged to lie about a circle 28 (i.e., that are not staggered), like that of FIGS. 1 and 2, as aspects of the invention are not limited in this respect.

Illustrative embodiments of the connector allow flexible beams to be configured to provide desired contact forces and appropriate ranges of motions to accommodate mating connectors during insertion. It is to be appreciated that beam mechanics may determine, at least partially, the amount of force that is associated with moving each of the flexible beams through their range of motion, and thus the contact force that is applied to a mating connector. Overlapping flexible beams, such as those shown in FIGS. 1 and 2, may provide space within the connector for each of the flexible beams to be configured to apply desired contact forces through a desired range of motion. Some of the variables that may be altered in the design of the beams include beam length, beam width in either the radial or circumferential direction, beam cross-sectional shape, material, and the like. The embodiments illustrated in FIGS. 1 and 2 are typically configured to provide about 5 grams to about 25 grams per contact point, against a mating connector, after the contact points move through a range of radial motion of about 0.008" from an unbiased position, or about 0.005' from a preloaded position. It is to be appreciated, however, that other ranges of motions and contact forces may be desirable for other embodiments, and that aspects of the invention are not limited to any one set of values.

Embodiments of the invention may facilitate manufacture in a cost effective manner. One approach for manufacturing the embodiment of FIG. 1 includes stamping components of the connector from sheets of conductive material as is described in greater detail below, and is illustrated in a representative manner in FIGS. 6*a*-6*c*.

Figure 6A:
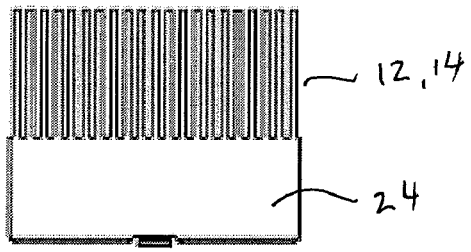
FIGS. 6*a*-6*c* show components of various embodiments of a connector during various stages of manufacture.
Figure 6B:
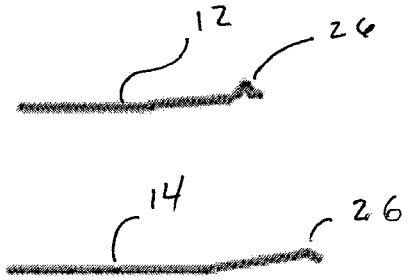
Figure 6C:
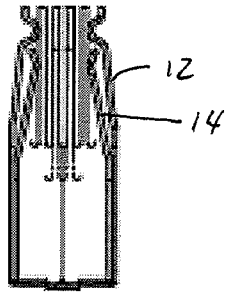
Figure 1:
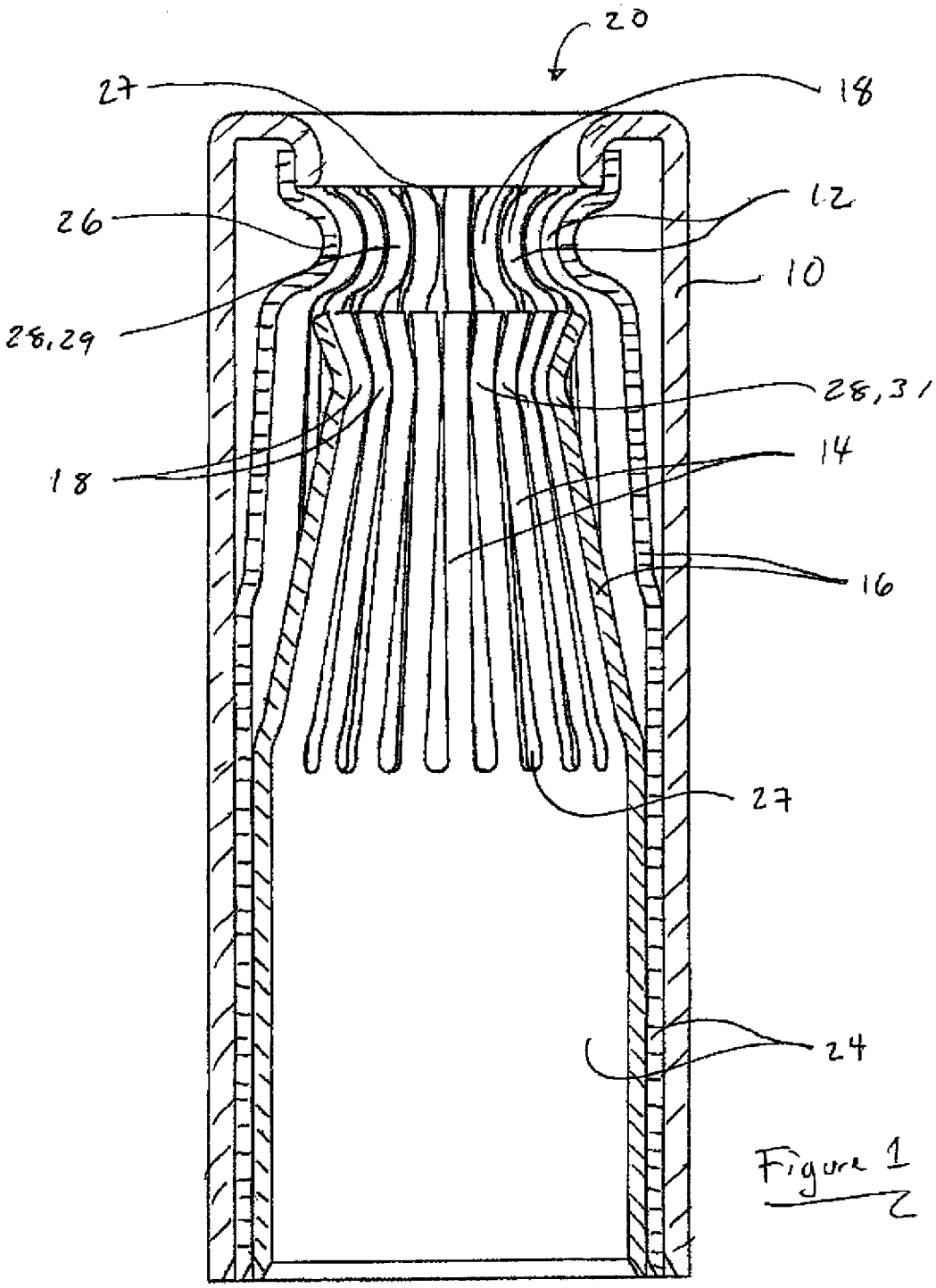
Figure 2:
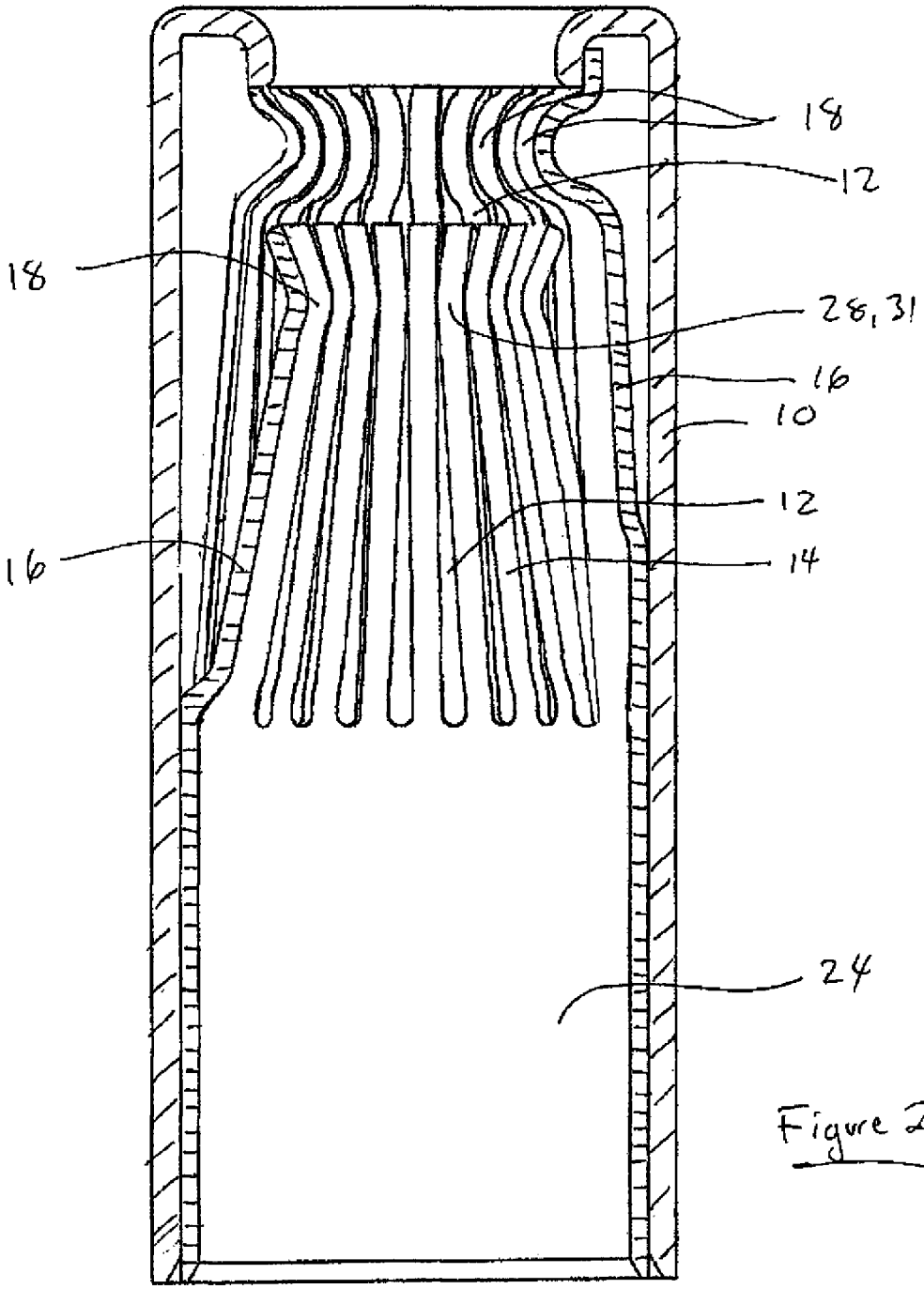
Figure 3:
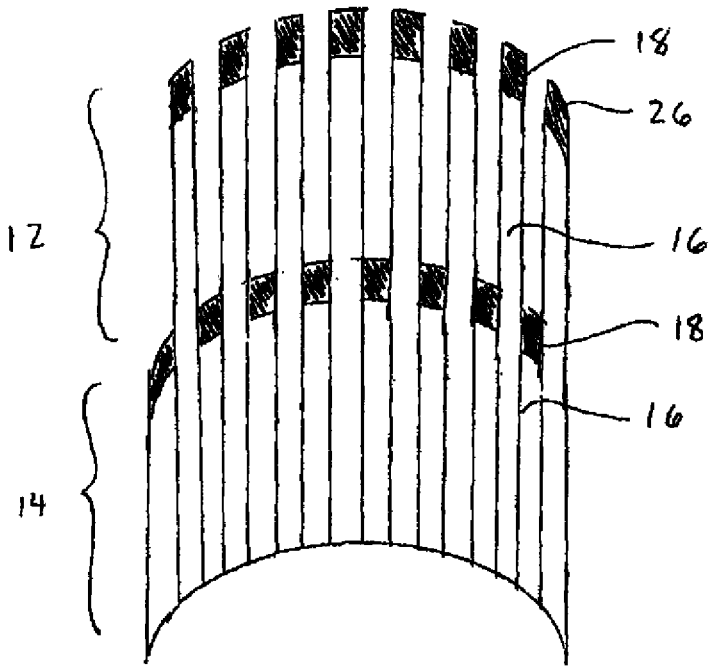
Figure 4:
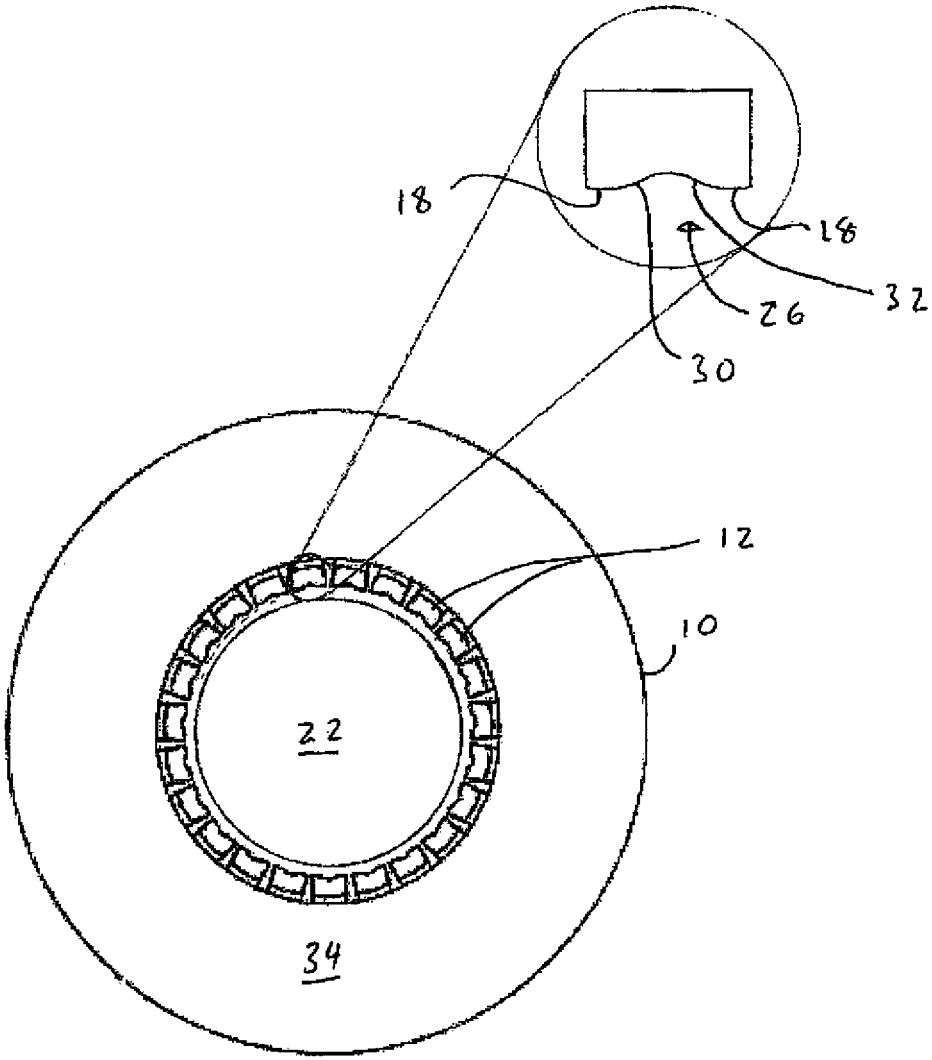

Initially, flat sheets of conductive material, like beryllium copper, are blanked to define flexible beams extending from a base, as shown in FIG. 6*a*. Each of the flexible beams may be blanked at a common time with a single die, or portions of the flexible array may be blanked progressively, at different times, as aspects of the invention are not limited in this manner. After blanking, the face of each flexible beam may be coined to define multiple contact points that will make contact with a mating connector. The flexible beams may be bent, either before or after blanking and/or coining, to define a contact area that extends into a plane other than that occupied by the base, and to shape the flexible beams as may be desired for a particular embodiment. Examples of how flexible beams of the first array and second array are shown in FIG. 6*b*. The sheets of material are then bent, about an axis that lies substantially parallel to the flexible beams, into a cylindrical shape. During this bending process, the contact areas extend inwardly toward the cylindrical cavity such that they lie along a smaller radius than the base of the sheet, which, as described herein, may reduce gaps between the contact areas. The cylindrical sheets of material that includes the second array of flexible beams may then be nested in the cylindrical sheet of material that includes the first array of beams, as shown in FIG. 6*c*. The nested arrays of flexible beams may then be positioned in a hood to form a connector.

It is to be appreciated that the above steps for manufacturing the embodiment of FIG. 1 are merely exemplary, and that other approaches may also be taken, as aspects of the invention are not limited in this respect. The order of steps may be altered, steps may be omitted, and/or steps may be accomplished by alternate approaches. The entire manufacturing process may be automated, performed manually, or may include any combination of automated and manual operations. By way of non-limiting example, the shape of the flexible beams maybe be imparted to a sheet of material prior to the sheet being blanked to define the flexible beams. According to yet another variation, connectors may be formed by continuously stamping the first and second arrays of flexible beams from two separate strips of metal. Machines that process the separate strips of material may be configured such that the first array of flexible beams is formed adjacent to the second array of flexible beams. Once stamped, the first and second arrays may be assembled together by sliding the arrays relative to one another as a part of the continuous forming process. Similarly, the hood may be slid onto the nested arrays of flexible beams as a part of the continuous forming process. In other embodiments, each of the first and second arrays may be progressively formed from different portions of a common strip of material.

The embodiment shown in FIG. 2, may be made through a procedure similar to that described above, except that the first and second arrays of flexible beams may be stamped from a common portion of a sheet of material such that they share a common base. In this respect, material costs for a connector may be reduced by eliminating the need for a larger sheet of material or a second sheet of material, and by reducing wasted material, such as material that would otherwise be removed from between the flexible beams. In this embodiment, a lancing process may be used to separate flexible beams of a first and second array from a common sheet of material. The flexible beams may be coined after the lancing process and shape may then be imparted to the flexible beams, either before or after the lancing process.

Various processes may also be used to form the hood. According to some approaches, the hood is formed of stainless steel and is shaped through a deep drawing process. Here, the hood may perform primarily a mechanical function. In other embodiments, the hood may also be stamped, like the flexible arrays of connectors, and may be made of a more conductive material, as aspects of the invention are not limited in this respect.

Various techniques may also be used to assemble the nested array of connectors to one another and/or to the hood. According to one approach, the first array of nested connectors is first positioned inside of the hood, and then the second arrays then positioned inside of the first array. Each of the arrays of flexible beams and the hood may then be held together through a fastening process, like welding, brazing, staking, and the like. In a staking process, a portion of material in the base of an array or the hood is deformed until the portion of material interferes with the mating component, and thus prevents the components from separating. In other embodiments, the first and second arrays may first be assembled together and then held together through various fastening techniques, like welding, riveting, press fitting, and/or staking. The assembled first and second arrays may then be positioned in the hood. Similar fastening techniques may be used to hold the assembled arrays of flexible beams to the hood.

Embodiments of the hood may be terminated to a mating component according to different approaches. In one embodiment, a conductive plug of material, such as copper, may be positioned within the base of the hood. The plug may compress the base of the sheet or sheets of material, in a press fit manner, against the hood to hold the connector in place. In another embodiment, the plug may be cylindrical in shape to allow a mating connector to pass therethrough.

Other modifications may be incorporated into the connector to accommodate various applications. By way of example, the base portion of the connector, and thus the overall length, may be extended if the connector is to provide mechanical support to a mating component, such as a cable. Such lengths may be reduced when less mechanical support may be involved, such as in board-to-board type connections. Applications that involve a hot plug may include a hood that is conductive or that incorporates conductive material that makes initial electrical contact with the mating connector, during insertion. In some embodiments, this conductive material may be positioned outside of the hood and may extend inwardly of the aperture in the hood, although other configurations are also possible.

Embodiments of the invention may be configured to transmit power or data. By way of example, each of the embodiments shown in FIGS. 1 and 2 are configured to transmit power. In such embodiments, each of the contact points are typically provide an electrical pathway to a common point in the connector, like the base. The base, in turn, may be terminated to a point outside of the connector to convey electrical power to a mating component. The high ratio of contact area to the size of the connector envelop may allow the connector to transmit electrical power with relative low losses, thus making embodiments suitable for power transmission.

The embodiments of FIGS. 1 and 2, as discussed herein, include a substantially cylindrical cavity that is to receive a round, pin-shaped mating connector. It is to be appreciated, however, that connectors may also be configured to define cavities for receiving mating connectors of other shapes. By way of example, embodiments may include arrays of flexible beams arranged to define a rectangular or square cavity for receiving a rectangular or square mating connector, a slot shaped cavity for receiving a card edge, or a metal blades of a bus bar. It is also to be appreciated that the connector described herein may be a subcomponent of a larger assembly, that in some cases, includes multiple connectors like those described herein.

Having thus described several aspects of at least one embodiment of this invention, it is to be appreciated various alterations, modifications, and improvements will readily occur to those skilled in the art. Such alterations, modification, and improvements are intended to be part of this disclosure, and are intended to be within the spirit and scope of the invention. Accordingly, the description and drawings herein are by way of example only.

The present invention is further illustrated by the following Examples, which in no way should be construed as further limiting.

EXAMPLES

Example 1

One example, constructed generally lie that shown in FIG. 1, has a first array of 23 flexible beams stamped from a 0.007" thick sheet of beryllium copper and a second array of 21 flexible beams stamped from a 0.007" thick sheet of beryllium copper. Each flexible beam of the first and second array is 0.010" wide. Flexible beams of the first array are preloaded against a hood, as shown in FIG. 5, such that the corresponding contact points lie about the cavity on a 0.084" diameter. Flexible beams of the second array are formed such that corresponding contact points lie about the cavity on a 0.076" diameter. Contact points of the first and second arrays are separated from one another, in the direction of insertion, by about 0.055" (i.e., the connector has a 0.055" insertion length). Each of the first and second arrays of flexible beams are situated in a hood with a 0.186" outer diameter. This example of one embodiment of the connector is configured to receive a 0.094" diameter (size 12) pin-shaped mating connector.

What is claimed is:

1. An electrical connector for mating with a mating connector, the electrical connector comprising:

a first array of flexible beams that extend from a base, the first array of flexible beams arranged about a cavity that is configured to receive the mating connector, distal portions of the flexible beams of the first array extending inwardly toward the cavity to define a first set of contact points that provide an electrical connection with the mating connector when received in the cavity; and a second array of flexible beams that extend from the base, the second array of flexible beams being nested with respect to the first array of flexible beams, distal portions of the second array of flexible beams extending inwardly toward the cavity to define a second set of contact points that provide an electrical connection with the mating connector when received in the cavity.

2. The electrical connector of claim 1, wherein the base, from which the first and second arrays of flexible beams extend, is a common sheet of material.

3. The electrical connector of claim 2, wherein the first and second arrays of flexible beams are formed from the common sheet of material.

4. The electrical connector of claim 3, wherein flexible beams of the first and second arrays are formed from the common sheet of material without removing material from between the beams of the first and second arrays.

5. The electrical connector of claim 1, wherein contact points of the first set are staggered about the cavity with respect to contact points of the second set.

6. The electrical connector of claim 1, wherein contact points of the first set are positioned substantially along a circle that lies about the cavity.

7. The electrical connector of claim 6, wherein contacts points of the second set are positioned substantially along a circle that lies about the cavity.

8. The electrical connector of claim 1, wherein each flexible beam of the first and second arrays includes a single contact point.

9. The electrical connector of claim 1, wherein each flexible beam of the first and second arrays has a pair of contact points.

10. The electrical connector of claim 1, wherein each flexible beam of the first and second arrays is substantially rectangular in cross-section.

11. The electrical connector of claim 1, further comprising:

a hood in which the first and second arrays of flexible beams are positioned, the hood including a substantially circular hood through which the mating connector is received.

12. The electrical connector of claim 11, wherein the hood engages flexible beams of the first array to prevent the flexible beams of the first array from extending inwardly into the cavity beyond a set point.

13. The electrical connector of claim 11, wherein the flexible beams of the first array are pre-loaded against the hood.

14. The electrical connector of claim 1, wherein the base comprises a first sheet of material from which the first array of flexible beams extend, and a second sheet of material, from which the second array of flexible beams extend.

15. The electrical connector of claim 1, in combination with the mating connector.

16. An electrical connector for mating with a mating connector, the electrical connector comprising:

a first array of flexible beams that extend from a base, the first array of flexible beams arranged about a substantially cylindrical cavity that is configured to receive the mating connector, distal portions of each flexible beam of the first array extending inwardly toward the cavity and having a contact area with a surface that defines two or more contact points to provide an electrical connection with the mating connector, when received in the cavity, wherein the two or more contact points are spaced from one another along a radius that revolves about the substantially cylindrical cavity.

17. The electrical connector of claim 16, further comprising:

a second array of flexible beams that extend from the base, the second array of flexible beams being nested inside of the first array of flexible beams, distal portions of each flexible beam of the second array extending inwardly toward the cavity and having a contact area with a surface that defines two or more contact points to provide an electrical connection with the mating connector, when received in the cavity, wherein the two or more contact points of each flexible beam of the second array are spaced from one another along a radius that revolves about the substantially cylindrical cavity.

18. The electrical connector of claim 17, wherein the base, from which the first and second arrays of flexible beams extend, is a common sheet of material.

19. The electrical connector of claim 18, wherein flexible beams of the first and second arrays are formed from the common sheet of material without removing material from between the beams of the first and second arrays.

20. The electrical connector of claim 17, wherein contact areas of the first array of flexible beams are staggered about the cavity with respect to contact areas of the second array of flexible beams.

21. The electrical connector of claim 17, wherein contacts areas of the first array of flexible beams are positioned substantially along a circle that lies about the cavity.

22. The electrical connector of claim 17, further comprising:

a hood in which the first and second arrays of flexible beams are positioned, the hood including a substantially circular hood through which the mating connector is received.

23. The electrical connector of claim 22, wherein the hood engages flexible beams of the first array to prevent the flexible beams of the first array from extending inwardly into the cavity beyond a set point.

24. The electrical connector of claim 22, wherein the flexible beams of the first array are pre-loaded against the hood.

25. The electrical connector of claim 16, in combination with the mating connector.

26. A method of forming an electrical connector, the method comprising:

providing a sheet of conductive material;

lancing portions of the sheet to separate a first array of flexible beams from a second array of flexible beams, the first and second array of flexible beams remaining connected to one another through a base portion of the sheet;

bending distal portions of the first array of flexible beams to define a first set of contact areas;

bending distal portions of the second array of flexible beams to define a second set of contact areas; and bending the base and first and second arrays of flexible beams to define a substantially cylindrical cavity configured to receive a mating connector.

27. The method of claim 26, wherein bending distal portions of the first array of flexible beams and bending distal portions of the second set of flexible beams occurs prior to lancing.

28. The method of claim 26, further comprising:

coining the distal portions of the first array of flexible beams to define a pair of contact points associated with each of the flexible beams of first array.

29. The method of claim 28, further comprising:

coining the distal portions of the second array of flexible beams to define a pair of contact points associated with each flexible beam of the second array.

30. The method of claim 26, wherein bending distal portions of the first array of flexible beams comprises bending the distal portions to define a first set of contact areas that will lie substantially in a circle about the cylindrical cavity.

31. The method of claim 30, wherein bending distal portions of the second array of flexible beams comprises bending the distal portions to define a second set of contact areas that will lie substantially in a circle about the cylindrical cavity.

32. The method of claim 26, further comprising:

mounting the base and first and second sets of flexible beams in a hood.

33. The method of claim 32, further comprising:

preloading the first array of flexible beams against the hood.

34. A method of forming an electrical connector, the method comprising:

providing first and second sheet portions of conductive material;

blanking the first sheet portion to define a first base portion and a first array of flexible beams extending therefrom;

blanking the second sheet portion to define a second base portion and a second array of flexible beams extending therefrom;

bending distal portions of the first array of flexible beams to define a first set of contact areas;

bending distal portions of the second array of flexible beams to define a second set of contact areas;

bending the first and second arrays of flexible beams to define a substantially cylindrical cavity configured to receive a mating connector; and nesting the second array of flexible beams in the first array of flexible beams.

35. The method of claim 34, wherein bending the first and second arrays of flexible beams to define the substantially cylindrical cavity occurs prior to nesting the second array of flexible beams in the first array of flexible beams.

36. The method of claim 34, further comprising:

coining the distal portions of the first array of flexible beams to define a plurality of contact points on each flexible beam of the first array.

37. The method of claim 34, further comprising:

coining the distal portions of the second array of flexible beams to define a plurality of contact points on each flexible beam of the second array.

38. The method of claim 34, further comprising:

mounting the first and second arrays of flexible beams in a hood.

39. The method of claim 38, further comprising:

preloading the first array of flexible beams against the hood.

* * * * *

UNITED STATES PATENT AND TRADEMARK OFFICE

CERTIFICATE OF CORRECTION

PATENT NO. : 7,806,737 B2
APPLICATION NO. : 12/025734
DATED : October 5, 2010
INVENTOR(S) : Mark et al.

It is certified that error appears in the above-identified patent and that said Letters Patent is hereby corrected as shown below:

The title page showing an illustrative figure should be deleted and substitute therefor the attached title page.

Delete drawing sheets 1-4 and substitute therefor the drawings sheets consisting of figures 1-4 as shown on the attached pages.

Signed and Sealed this
Twenty-seventh Day of March, 2012

David J. Kappos

David J. Kappos
*Director of the United States Patent and Trademark Office*

(12) United States Patent
Mark et al.

(10) Patent No.: US 7,806,737 B2
(45) Date of Patent: Oct. 5, 2010

(54) STAMPED BEAM CONNECTOR

(75) Inventors: Gregory T. Mark, Cambridge, MA (US); Andrew M. Wallace, Cambridge, MA (US); Hannah Han, Fremont, CA (US); Walter William Wurster, Reno, NV (US); Michael Allen Gustafson, Reno, NV (US); Russell G. Larsen, San Jose, CA (US)

(73) Assignee: Methode Electronics, Inc., Chicago, IL (US)

( * ) Notice: Subject to any disclaimer, the term of this patent is extended or adjusted under 35 U.S.C. 154(b) by 0 days.

(21) Appl. No.: 12/025,734

(22) Filed: Feb. 4, 2008

(65) Prior Publication Data

US 2009/0197482 A1 Aug. 6, 2009

(51) Int. Cl.
*H01R 13/187* (2006.01)

(52) U.S. Cl. ..... 439/843

(58) Field of Classification Search ..... 439/843, 439/851, 181, 520

See application file for complete search history.

(56) References Cited

U.S. PATENT DOCUMENTS

| | | | | |
|---|---|---|---|---|
| 2,394,020 | A | | 2/1946 | Soreny |
| 3,530,422 | A | | 9/1970 | Goodman |
| 3,665,370 | A | | 5/1972 | Hartmann |
| 3,927,926 | A | | 12/1975 | Powell |
| 4,227,767 | A | | 10/1980 | Mouissie |
| 4,462,657 | A | | 7/1984 | Snowdon et al. |
| 4,810,213 | A | | 3/1989 | Chabot |
| 4,927,369 | A | | 5/1990 | Grabbe |
| 5,030,109 | A | | 7/1991 | Dery |
| 5,061,191 | A | | 10/1991 | Casciotti et al. |
| 5,088,942 | A | | 2/1992 | Welsh |
| 5,092,781 | A | | 3/1992 | Casciotti et al. |
| 5,094,636 | A | * | 3/1992 | Zinn et al. ..... 439/839 |
| 5,154,626 | A | | 10/1992 | Watson |
| 5,232,372 | A | | 8/1993 | Bradley |
| 5,273,438 | A | | 12/1993 | Bradley et al. |
| 5,297,968 | A | | 3/1994 | Johnson et al. |
| 5,634,801 | A | | 6/1997 | Johnson |
| 5,667,413 | A | * | 9/1997 | Trafton ..... 439/843 |
| 5,730,628 | A | | 3/1998 | Hawkins |
| 5,913,687 | A | | 6/1999 | Rathburn |
| 6,062,919 | A | | 5/2000 | Trafton |
| 6,102,746 | A | | 8/2000 | Nania et al. |

(Continued)

FOREIGN PATENT DOCUMENTS

| | | |
|---|---|---|
| FR | 465535 | 4/1914 |

(Continued)

OTHER PUBLICATIONS

PCT Search Report dated Mar. 10, 2009.

(Continued)

*Primary Examiner*—Khiem Nguyen
(74) *Attorney, Agent, or Firm*—Barnes & Thornburg LLP

(57) ABSTRACT

An electrical connector includes a first and second array of flexible beams that are overlapped within a hood and that define a substantially cylindrically cavity for receiving a mating connector. Contact areas of each of the flexible beams may be shaped to define multiple contact points, thus increasing the overall area available for current to pass.

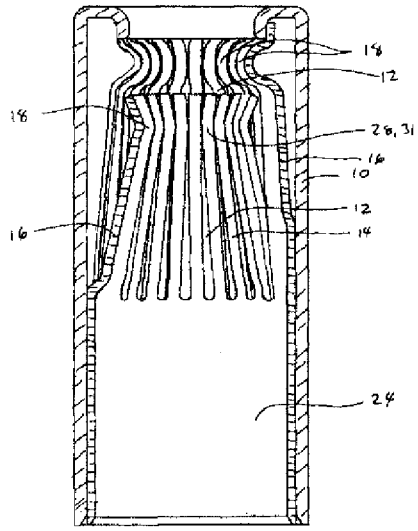

39 Claims, 6 Drawing Sheets